United States Patent [19]

Ditto et al.

[11] 4,303,190

[45] Dec. 1, 1981

[54] COMPOSITE END CLOSURE MEMBER FOR COMPOSITE CONTAINERS

[75] Inventors: Peter J. Ditto, St. Ann; Donald H. Ellerbrock, Florissant; Peter G. Pelton, St. Louis, all of Mo.

[73] Assignee: Boise Cascade Corporation, Boise, Id.

[21] Appl. No.: 160,312

[22] Filed: Jun. 17, 1980

[51] Int. Cl.[3] ..... B65D 3/14

[52] U.S. Cl. ..... 229/5.6; 220/68

[58] Field of Search ..... 229/5.6, 5.5, 5.8, 4.5, 229/1.5 B; 220/67, 68

[56] References Cited

U.S. PATENT DOCUMENTS

| | | | |
|---|---|---|---|
| 809,813 | 1/1906 | Kimsey | 229/5.6 |
| 1,498,909 | 6/1924 | Guimm | 229/5.5 |
| 2,433,926 | 1/1948 | Sayre | 229/1.5 B |
| 2,970,736 | 2/1961 | Baughan | 229/5.6 |
| 3,049,277 | 8/1962 | Shappell | 229/1.5 B |
| 3,322,318 | 5/1967 | Felton | 229/5.6 |
| 3,381,594 | 5/1968 | Ellerbrock | 229/5.6 |
| 4,163,504 | 8/1979 | Elser | 229/5.6 |

FOREIGN PATENT DOCUMENTS

| | | | |
|---|---|---|---|
| 776988 | 1/1968 | Canada | 229/1.5 B |
| 1073467 | 6/1967 | United Kingdom | 229/5.6 |

*Primary Examiner*—Herbert F. Ross

*Attorney, Agent, or Firm*—Laubscher, Philpitt & Laubscher

[57] ABSTRACT

An improved composite container is disclosed in which a composite end closure member having a horizontal generally disk-shaped central portion and an annular flange portion is bonded to one end of a tubular cylindrical composite body member, preferably by the use of radio frequency or dielectric energy. Preferably, the body member end portion is reversely inwardly curled to define an upwardly extending curled portion the free extremity of which is contiguous with the end member, thereby to structurally reinforce the container and to more securely hold the end member in place.

7 Claims, 7 Drawing Figures

Fig. 4
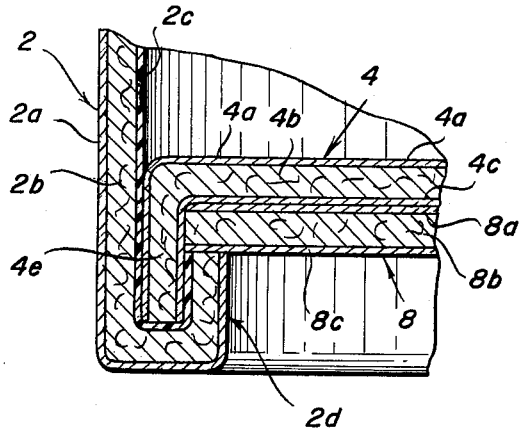
Fig. 6
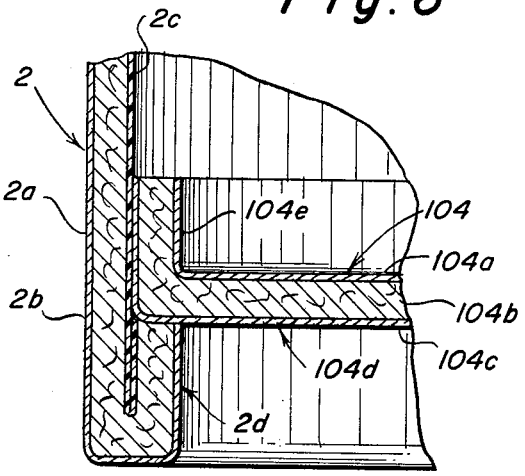
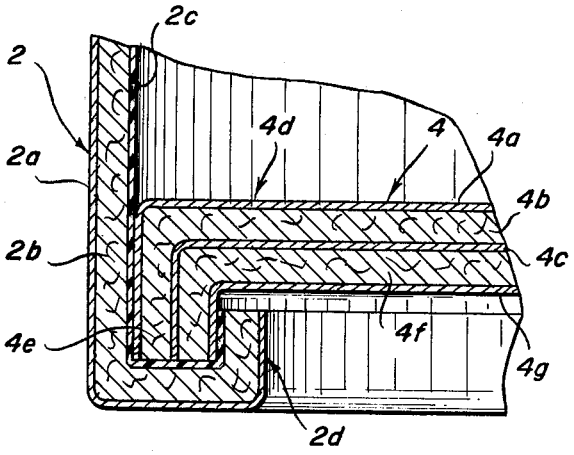
Fig. 5
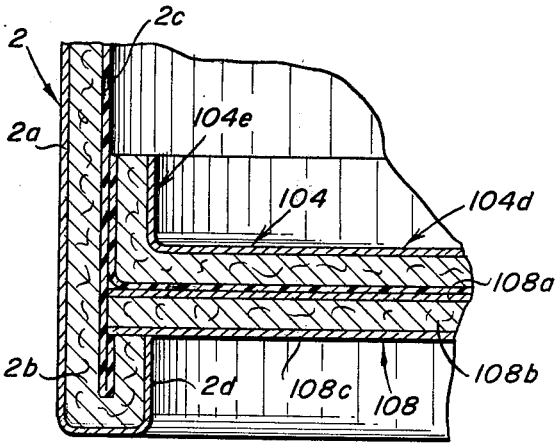
Fig. 7

COMPOSITE END CLOSURE MEMBER FOR COMPOSITE CONTAINERS

BRIEF DESCRIPTION OF THE PRIOR ART

Composite containers having composite ends are well known in the art, as evidenced by the patents to Griese, Jr., U.S. Pat. No. 3,151,765, Betner U.S. Pat. No. 3,317,068, Sternau U.S. Pat. No. 3,348,358, Christine et al U.S. Pat. No. 3,391,847, and Smith et al U.S. Pat. No. 3,949,927. Such containers have utility in the packaging of frozen citrus juices, dough, dry powders, cleansers, motor oil and the like. In such containers, by avoiding the use of conventional metal end closure members, the cost of the resulting container is significantly reduced. One problem in the known composite containers is that of effecting a positive, leak-free rugged seal between the body and end closure members in a relatively short period of time.

SUMMARY OF THE INVENTION

The present invention relates to an improved composite container including a composite body member and a composite end closure member, wherein the members are connected in a positive leak-free manner, preferably by means of a thermal bond produced by a radio frequency or dielectric energy. The composite end and body members of the subject invention each have at least one fibrous layer. The composite end closure member, which is mounted at one end of the composite body member, has a horizontal, generally disk-shaped central portion, and a peripheral flange portion. The peripheral flange portion is preferably heat sealed to the container inner liner layer using radio frequency or dielectric energy. When using radio frequency energy, a metal such as aluminum foil must be present in combination with a heat sealable material to effect proper sealing of the heat sealable material. When using dielectric energy, moisture which is present in the fibrous layer of the composite material is heated to effect a proper heat seal bond between the composite end member and the composite body member. It is also possible to use a thermoplastic bonding material that contains a polarized molecule material, including polyvinyl chloride, nylon or the like. The end of the body member may be reversely inwardly curled to structurally reinforce the container and to more firmly secure the composite end closure member to the composite body member. In some embodiments, a reinforcing disk is placed between the end closure member and the reversely inwardly curled end of the body member to further reinforce the end closure structure.

Accordingly, a primary object of the present invention is to provide an improved composite container having a composite end member thermally bonded, for example, by radio frequency or dielectric energy, to a composite body member, which container is suitable for use in the packaging of frozen citrus juice, dough, motor oil and the like, thereby eliminating the need for more expensive metal ends.

BRIEF DESCRIPTION OF THE DRAWING

Other objects and advantages of the invention will become apparent from a study of the following specification when viewed in light of the accompanying drawing, in which:

FIGS. 3–5 are detailed sectional views of three modifications of the invention of FIG. 1, respectively;

FIG. 6 is a detailed view of a second embodiment of the invention wherein the flange portion of the end closure member extends upwardly; and FIG. 7 is a modification of the embodiment of FIG. 6.

DETAILED DESCRIPTION

Figure 1:
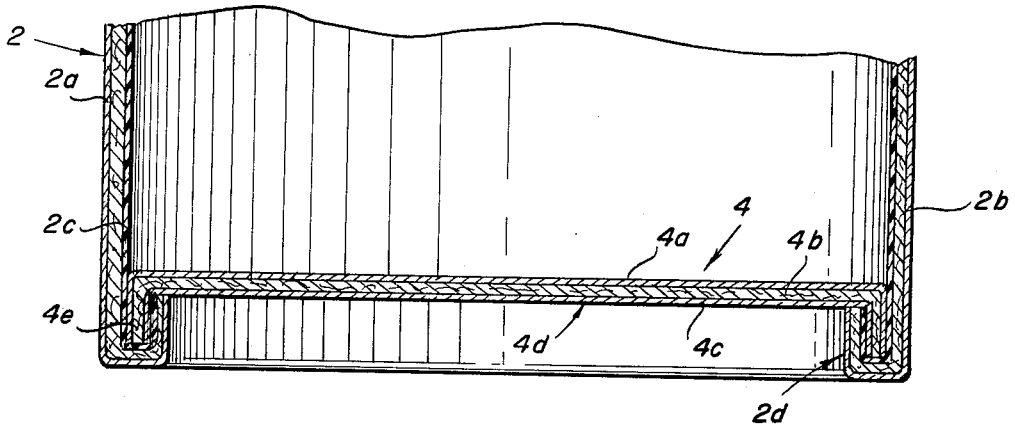
FIGS. 1 and 2 are detailed sectional views of a first embodiment of the invention, wherein the flange portion of the end closure member extends downwardly.
Figure 2:
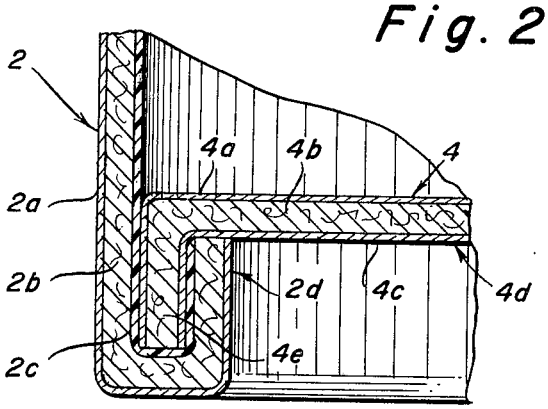

Referring first more particularly to FIGS. 1 and 2, the helically-wound cylindrical tubular composite body member 2 includes an outer label layer 2*a* (of paper or foil), a fibrous body wall layer 2*b* (normally of paper), and an inner liner layer 2*c* (preferably of a heat sealable material, such as polyethylene.) The lower end of the vertically arranged body member is closed by a composite end closure member 4 having an inner layer 4*a* formed of heat sealable material, such as polyethylene, a fibrous layer 4*b* (formed of paper), and an outer layer 4*c*, preferably formed of a heat sealable material, such as polyethylene. The end closure member includes a disk-shaped central portion 4*d* extending horizontally across and spaced from the lower end of the body wall member, and a downwardly depending annular flange portion 4*3*. The lower end of the body wall member includes a reversely inwardly curled terminal portion 2*d* that extends upwardly into abutting engagement with the lower surface of the disk portion 4*d* of the end closure member 4.

In accordance with the present invention, the outer surface of the flange portion 4*e* is bonded to the inner liner layer 2*c* of the body member, preferably by a heat sealed bond produced by high frequency or dielectric energy. In the former case, the inner layer 2*c* of the body wall layer and/or the outer layer 4*c* of the end closure member is formed of metal, such as aluminum foil. Furthermore, the seal can be improved by also bonding the inner surface of the end closure flange portion 4*e* to the adjacent surface of the curl portion 2*d*. To this end, the outer layer 4*c* of the end closure member may be formed of a material (such as polyethylene) that is heat sealable to the inner liner layer 2*c* of the body wall.

Figure 3:
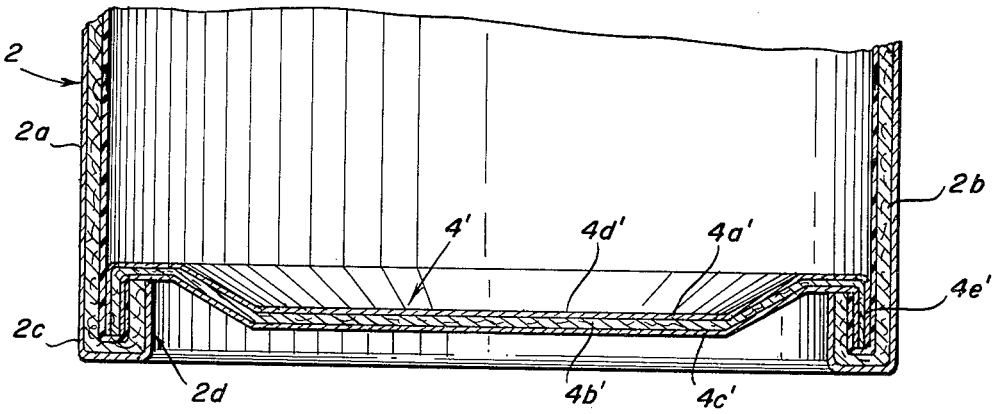

In the embodiment of FIG. 1, the disk portion 4*d* is generally planar, and in the modification of FIG. 3, the central part of the disk portion 4*d* is deformed downwardly, thereby to increase the volume and/or strength of the container.

Referring now to the embodiment of FIG. 4, a rigid composite reinforcing disk 8 is supported by the reversely curled portion 2*d* for extending in reinforcing supporting relation beneath the central disk portion 4*d* of the end closure member. The reinforcing disk includes an upper layer 8*a* (of paper, foil, or synthetic plastic material, such as polyethylene), a fibrous (paper) central layer 8*b*, and an outer layer 8*c* (preferably of foil).

In the modification of FIG. 5, the end closure member 4 includes a further fibrous layer 4*f*, and an outer protective layer 4*g* (of foil, paper or synthetic plastic material), which further fibrous layer 4*f* serves to strengthen the center of the end closure member 4. The flange portion 4*e* of the end closure member is bonded to the inner surface of the body wall, and preferably, the reversely curled body portion is bonded to the outer peripheral surface 4*c* of the flange portion 4*e*.

Referring now to the embodiment of FIG. 6, the flange portion 104*e* of the end closure member 104 extends upwardly, the disk portion 104*d* being supported by the reverse curl portion 2*d*. In this embodiment, only the outer circumferential surface of the flange portion 104 of the end closure member is bonded to the inner liner layer 2*c* of the body member. Consequently, the outer layer 104*c* of the end closure member is formed of a material (such as paper, polyethylene or the like) that is heat sealable to the inner liner layer 2*c*.

In the modification of FIG. 7, a composite reinforcing disk 108 is supported by the curl portion 2*d* for supporting the central part of central disk 104*d*. The central layer 108*b* of the reinforcing disk is formed of fibrous material such as paper, and the upper and lower layers are formed of paper, foil, or synthetic plastic material, such as polyethylene.

During assembly, the end member is punched and inserted in one end of the preformed helically wound composite container body. After assembly, aligning, and folding are completed, the end closure member is heat sealed to the container body member using radio frequency or dielectric heating apparatus. In radio frequency sealing, the container liner layer 2*c* is preferably formed of a heat sealable material, such as polyethylene, while the end member inner and/or outer layers are formed from metal foil. Alternatively, the container liner layer 2*c* may be metal foil and the closure inner and/or outer layers may contain the heat sealable material. The heat sealable material may be polyethylene, polypropylene, ethylene vinyl acetate, surlyn, polyvinyl chloride or any other conventional heat sealable synthetic plastic material. It is not necessary for the heat sealable material to be included as one of the composite material layers as previously described, but may be added to the end structure during assembly. When dielectric energy is used, it is not necessary for a metal material to be included, but a substance to be heated such as water which is present in the fibrous layers is necessary to effect a proper heat seal of the closure member to the body member.

While the preferred forms and embodiments have been illustrated and described, various changes and modifications may be made without deviating from the inventive concepts set forth above.

What is claimed is:

1. A composite container, comprising (a) a tubular cylindrical helically-wound vertically-arranged composite body member (2) including at least one fibrous body wall layer (2*b*), and an inner liner layer (2*c*);

(b) a cup-shaped composite end closure member (4) for closing the lower end of said body member, said closure member including a central fibrous layer (4*b*), and inner and outer layers (4*a*, 4*c*) arranged on opposite sides of said central fibrous layer, said end closure member having a central disk-shaped portion (4*d*) arranged horizontally within, and spaced from the lower extremity of, said body member, and an annular flange portion (4*e*) extending vertically downwardly from the periphery of said central portion adjacent the inner surface of said body member;

(c) means bonding the outer circumferential surface of said end closure flange portion with the inner surface of said body member; and (d) a composite reinforcing disk member (8) arranged horizontally and in contiguous engagement with substantially the entire lower surface of said end closure central portion, said reinforcing disk member having an upper layer, a central fibrous layer and a lower layer;

(e) the lower extremity of said body member being reversely curled successively inwardly and upwardly about said flange portion to define an annular terminal curled portion (2*d*) that extends upwardly toward, and terminates in abutting supporting engagement with, the lower surface of said reinforcing disk member, thereby to retain said disk member in reinforcing supporting engagement with the lower surface of said end closure central portion.

2. A composite container as defined in claim 1, wherein said bond means comprises a radio-frequency-energy heat-sealed bond.

3. A composite container as defined in claim 1, wherein said means defining said bond means comprises a dielectric-energy heat-sealed bond.

4. A composite container as defined in claim 1, wherein said reversely curled body member portion is bonded to the inner peripheral surface of said end closure flange portion.

5. A composite container as defined in claim 1, wherein the inner liner layer of said body member comprises a heat sealable material selected from the group consisting of polyethylene, polypropylene, ethylene vinyl acetate, surlyn, and polyvinyl chloride.

6. A composite container as defined in claim 1, wherein at least one of the inner and outer layers of said end closure member comprises a heat sealable material selected from the group consisting of polyethylene, polypropylene, ethylene vinyl acetate, surlyn, and polyvinyl chloride.

7. A composite container as defined in claim 6, wherein the other of said inner and outer layers of said closure member comprises a layer of metal foil.

* * * * *